US009210955B2

(12) United States Patent
Dandapure et al.

(10) Patent No.: US 9,210,955 B2
(45) Date of Patent: Dec. 15, 2015

(54) BRA

(71) Applicant: LULULEMON ATHLETICA CANADA INC., Vancouver (CA)

(72) Inventors: Yogendra V. Dandapure, Richmond (CA); Cassandra Ming Wai Sze, Vancouver (CA); David John Williams, Hong Kong (CN)

(73) Assignee: LULULEMON ATHLETICA CANADA INC., Vancouver (CA)

( * ) Notice: Subject to any disclaimer, the term of this patent is extended or adjusted under 35 U.S.C. 154(b) by 54 days.

(21) Appl. No.: 13/652,696

(22) Filed: Oct. 16, 2012

(65) Prior Publication Data

US 2013/0225045 A1 Aug. 29, 2013

Related U.S. Application Data

(60) Provisional application No. 61/547,889, filed on Oct. 17, 2011.

(51) Int. Cl.
*A41C 3/00* (2006.01)
*A41C 5/00* (2006.01)

(52) U.S. Cl.
CPC ..... *A41C 3/00* (2013.01); *A41C 3/0014* (2013.01); *A41C 5/005* (2013.01)

(58) Field of Classification Search
CPC ..... A41C 5/00; A41C 3/00; A41C 3/0014; A41C 3/0057; A41C 3/10
USPC ..... 450/39, 92, 93, 30–33, 28, 86
See application file for complete search history.

(56) References Cited

U.S. PATENT DOCUMENTS

| | | | |
|---|---|---|---|
| 1,215,602 | A | 2/1917 | Williams |
| 1,705,113 | A | 3/1929 | Harvey |
| 2,380,199 | A | 7/1945 | Stein |
| 2,730,974 | A | 1/1956 | Ross et al. |
| 2,867,889 | A | 1/1959 | Thompson, Jr. |
| 2,973,764 | A | 3/1961 | Steiner |

(Continued)

FOREIGN PATENT DOCUMENTS

| | | |
|---|---|---|
| CA | 124967 | 4/2009 |
| CN | 2887092 | 4/2007 |

(Continued)

OTHER PUBLICATIONS

U.S. Appl. No. 29/404,148.

(Continued)

*Primary Examiner* — Gloria Hale
(74) *Attorney, Agent, or Firm* — DLA Piper LLP US

(57) ABSTRACT

A bra comprising a front portion, the front portion comprising bra cups; two side portions, each side portion extending from a respective side of the front portion, wherein the side portions are adapted to encircle a torso of a wearer of the bra; wherein the front portion and the side portions are comprised of an outer layer and a frame layer beneath the outer layer; wherein the front portion is further comprised of an inner layer beneath the frame layer, wherein the bra cups are molded in the inner layer of the front portion; wherein the frame layer comprises: an outer frame layer primarily stretchable in a first direction; and an inner frame layer comprising at least one panel primarily stretchable in the first direction.

32 Claims, 11 Drawing Sheets

(56) References Cited

U.S. PATENT DOCUMENTS

| | | | | |
|---|---|---|---|---|
| 3,378,012 | A | 4/1968 | Schwartz | |
| 4,172,002 | A | 10/1979 | Gluckin | |
| 5,385,502 | A * | 1/1995 | Moretz et al. | 450/93 |
| 5,690,537 | A | 11/1997 | Kalmus | |
| 5,769,688 | A | 6/1998 | Holliday | |
| 5,820,444 | A | 10/1998 | McGaughey | |
| 6,198,204 | B1 | 3/2001 | Pottenger | |
| 6,645,040 | B2 * | 11/2003 | Rabinowicz et al. | 450/1 |
| 6,769,358 | B2 * | 8/2004 | Jordan | 101/129 |
| 7,131,888 | B2 * | 11/2006 | Hsu | 450/39 |
| 7,169,011 | B2 * | 1/2007 | Mitchell et al. | 450/66 |
| 7,192,332 | B2 | 3/2007 | Liu | |
| D550,368 | S | 9/2007 | Hankins | |
| D578,277 | S | 10/2008 | Lung | |
| 7,435,155 | B2 | 10/2008 | Reinisch | |
| 7,563,152 | B2 | 7/2009 | Liu | |
| D608,979 | S | 2/2010 | Wayns | |
| 7,654,882 | B2 | 2/2010 | Berner | |
| 7,666,058 | B2 | 2/2010 | Smith | |
| 7,677,952 | B2 | 3/2010 | Wooley | |
| 7,690,965 | B2 * | 4/2010 | Falla et al. | 450/92 |
| 7,758,401 | B2 * | 7/2010 | Kelley et al. | 450/92 |
| 7,833,082 | B2 * | 11/2010 | Bugada | 450/39 |
| 7,862,401 | B2 * | 1/2011 | Watrin et al. | 450/39 |
| 7,887,390 | B2 | 2/2011 | Dowe | |
| 8,113,908 | B1 * | 2/2012 | Modena et al. | 450/39 |
| 8,113,911 | B1 | 2/2012 | Hansen | |
| 8,317,567 | B2 * | 11/2012 | Watrin et al. | 450/39 |
| 8,480,452 | B2 * | 7/2013 | Reinisch et al. | 450/39 |
| 2004/0106354 | A1 * | 6/2004 | Falla et al. | 450/41 |
| 2006/0105673 | A1 | 5/2006 | Lau | |
| 2006/0105674 | A1 | 5/2006 | Lau | |
| 2006/0223415 | A1 * | 10/2006 | Watrin et al. | 450/39 |
| 2006/0281389 | A1 | 12/2006 | Liu | |
| 2007/0021035 | A1 * | 1/2007 | Bugada | 450/39 |
| 2007/0066181 | A1 | 3/2007 | Lau | |
| 2009/0098803 | A1 | 4/2009 | Reinisch et al. | |
| 2010/0240279 | A1 | 9/2010 | Otsuka | |
| 2011/0016616 | A1 | 1/2011 | Crouch | |
| 2012/0108143 | A1 | 5/2012 | Sherwood | |
| 2012/0122371 | A1 * | 5/2012 | Reinisch et al. | 450/93 |

FOREIGN PATENT DOCUMENTS

| | | |
|---|---|---|
| CN | 201468028 U | 5/2010 |
| GB | 762282 | 11/1956 |
| JP | 2007-154345 | 6/2007 |

OTHER PUBLICATIONS

International Search Report Corrected Version issued in International Application No. PCT/CA2012/000936 dated Feb. 15, 2013.

Written Opinion issued in International Application No. PCT/CA2012/000936 dated Dec. 31, 2012.

Office Action issued in Chinese Application No. 201280050848.4 dated Mar. 30, 2015.

Partial English language translation of Office Action issued in Chinese Application No. 201280050848.4 dated Mar. 30, 2015.

English language abstract of CN 2887092 published Apr. 11, 2007.

English language abstract of CN 201468028 U published May 19, 2010.

Machine English language translation of JP 2007-154345 published Jun. 21, 2007.

* cited by examiner

BRA

CROSS-REFERENCE TO RELATED APPLICATIONS

This application is based on and derives the benefit of the filing date of U.S. Provisional Patent Application No. 61/547,889, filed Oct. 17, 2011. The entire content of this application is herein incorporated by reference in its entirety.

BRIEF DESCRIPTION OF THE DRAWINGS

The foregoing summary and the following detailed description are better understood when read in conjunction with the appended drawings. Example embodiments are shown in the drawings, however, it should be understood that the embodiments are not limited to the specific methods and instrumentalities depicted herein. In the drawings.

DETAILED DESCRIPTION OF EMBODIMENTS

Figure 1A:
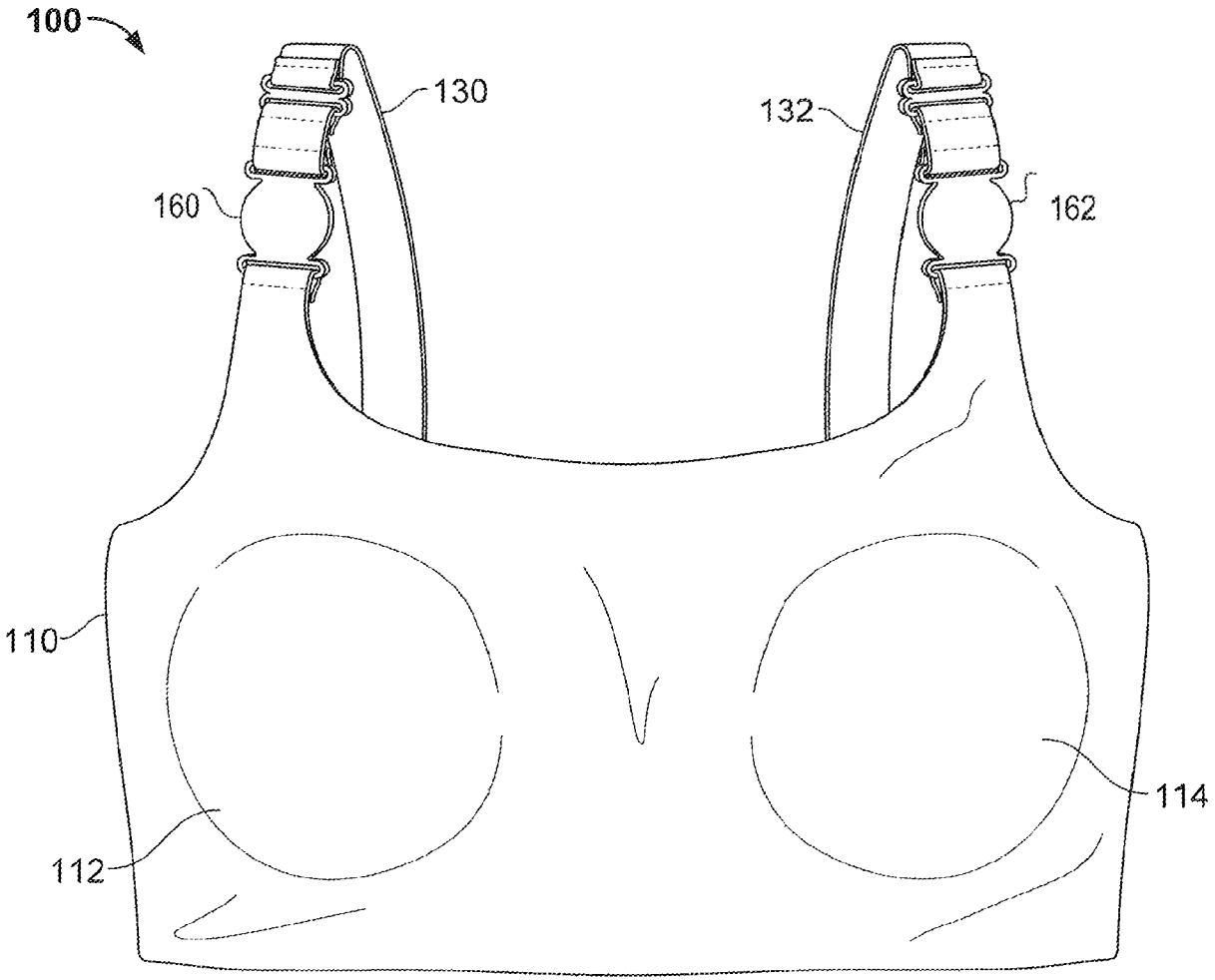
FIGS. 1*a* and 1*b* illustrate perspective outer and inner front views of a bra, respectively, according to an embodiment.
Figure 1B:
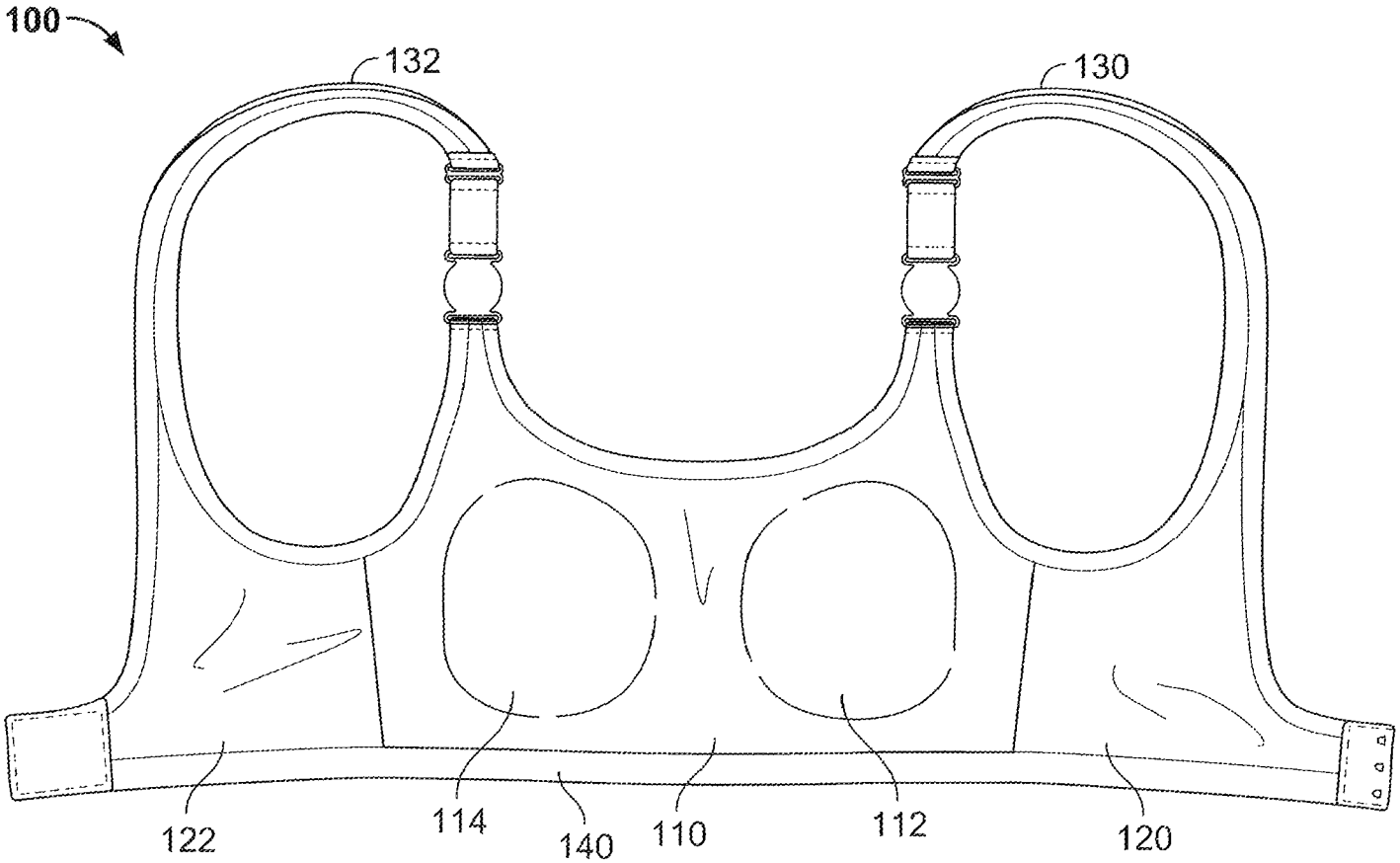

With reference to FIGS. 1*a* and 1*b*, front views of a bra 100, according to an embodiment, are illustrated. FIG. 1*a* provides a front view of the outer side of the bra 100, while FIG. 1*b* provides a front view of the inner side of the bra 100. The bra 100 can include a front portion 110 with bra cups 112 and 114. The bra 100 can also include side portions 120 and 122, each extending from a respective side of the front portion 110. The side portions 120, 122 can be adapted to encircle a torso of a wearer of the bra 100.

The bra 100 can also include shoulder straps 130 and 132. The shoulder straps 130, 132 can extend from a top portion of the front portion 110 to respective top portions of the two side portions 120, 122 so that the shoulder straps 130, 132 encircle the shoulders of the wearer of the bra 100. Connector components 160, 162 may be used to secure or attach the shoulder straps 130, 132 to the top portion of the front portion 110. The connector components 160, 162 may, together with a loop(s) on the shoulder straps 130, 132 and a hook(s) at the end of the shoulder straps 130, 132, provide for the wearer of the bra 100 to adjust the shoulder straps 130, 132 to obtain a customized fit. The loops on the shoulder straps 130, 132 may be made from the same fabric utilized elsewhere on the bra 100, with the frame fabric at core and welded to form loops.

A chest band 140 may be an extension, according to some embodiments, of the front portion 110 and/or the side portions 120, 122 at a bottom portion of the front portion 110 and/or the side portions 120, 122. According to an additional embodiment, the chest band 140 may be a piece of material (e.g., elastic) attached or otherwise secured to the bottom portion of the front portion 110 and/or the side portions 120, 122. If the chest band 140 is made of elastic, the elastic may be 25 mm in width and may have a content of 68% nylon and 32% spandex, or any other combination of fibers. The elastic may be woven or any other type of construction. The elastic may have a modulus of 1.25 lbf at 20% elongation. The elastic may be brushed or any other surface treatment may be used.

Figure 2:
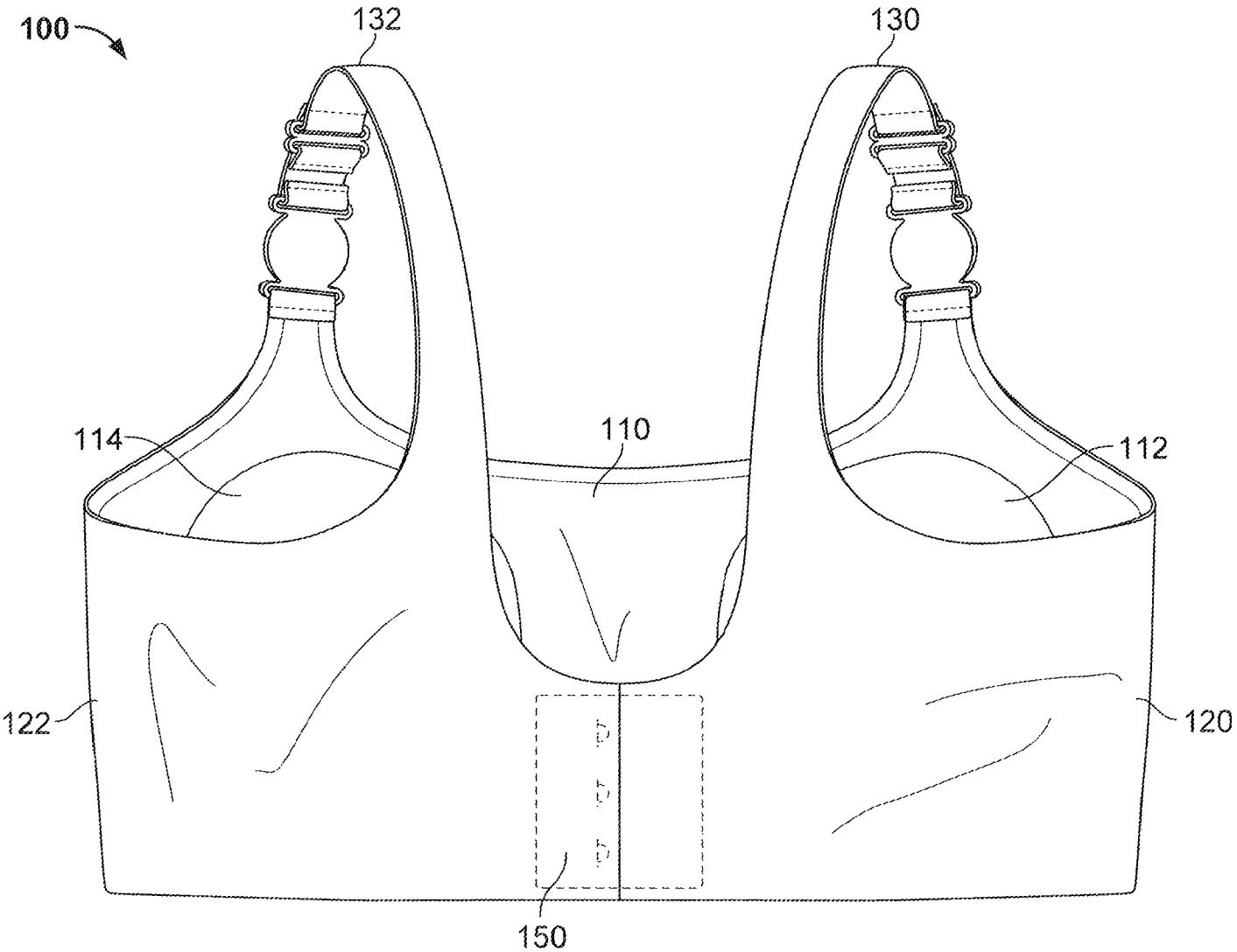
FIG. 2 illustrates a perspective back view of a bra, according to an embodiment.

FIG. 2 provides a perspective back view of the bra 100, according to one embodiment. As shown in FIG. 2, a fastening mechanism 150 may be provided to secure the bra 100 to the bra wearer. The fastening mechanism 150 may include, according to an embodiment, at least one hook and a corresponding at least one eye. The set of hooks may be attached to an end portion of one of the two side portions 120, 122, and the set of eyes may be attached to an end portion of the other of the two side portions 120, 122. Other known fastening mechanisms may also be utilized.

Figure 10:
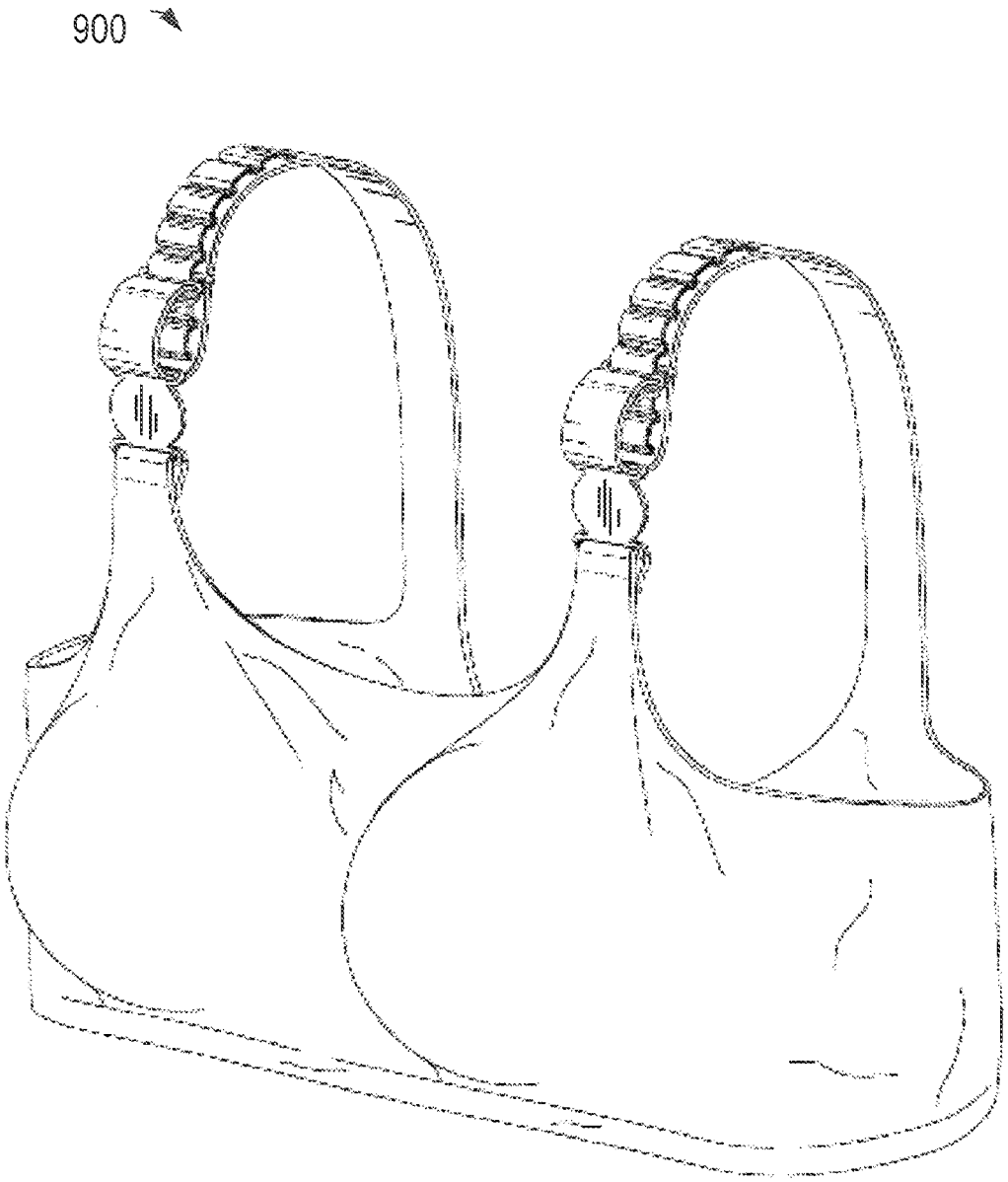
FIG. 10 illustrates a perspective side view of a bra, according to an embodiment.

FIG. 10 provides a perspective side view of another embodiment of a bra, where the shoulder straps are different than bra 100 shown in FIGS. 1*a*-3 and FIGS. 8*a*-8*b*.

Figure 3:
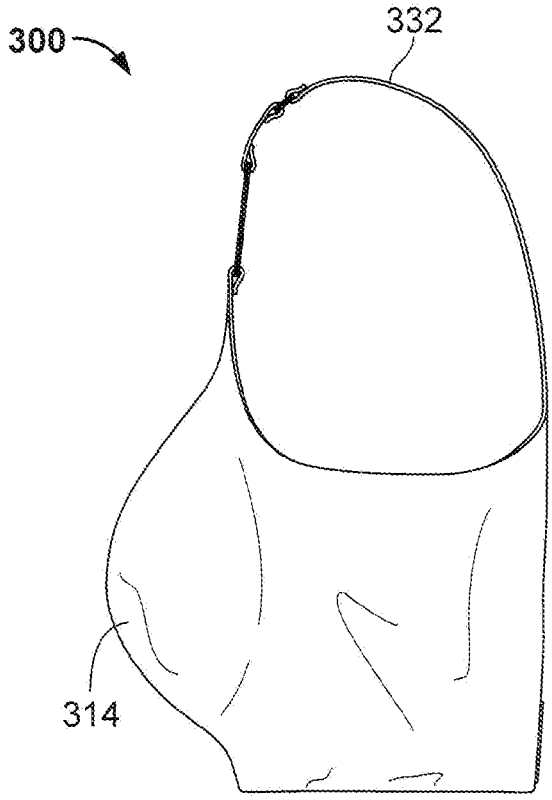
FIG. 3 illustrates a perspective side view of a bra, according to an embodiment.

FIG. 3 provides a perspective side view of the bra 100, according to one embodiment. The bra 100 can comprise a plurality of layers, each described below with reference to FIGS. 4-7. An innermost layer (inner layer 400) may be a spacer fabric that provides coverage as well as compression. The spacer fabric may be cut with ultrasonic waves to seal all the edges of the fabric. The inner layer 400 may be viewed as a set of molded cups that may be attached to a bra frame. The frame (inner frame layer 500 and outer frame layer 600) may include two layers of fabric that can provide support to the base of a wearer's breasts while also adding compression. An outermost layer (outer layer 700) can provide an aesthetic appearance due to its seamless quality, as well as providing wicking qualities by pulling away moisture from the frame and innermost layer. The outermost layer may also provide additional compression and coverage to the breast area.

Figure 4:
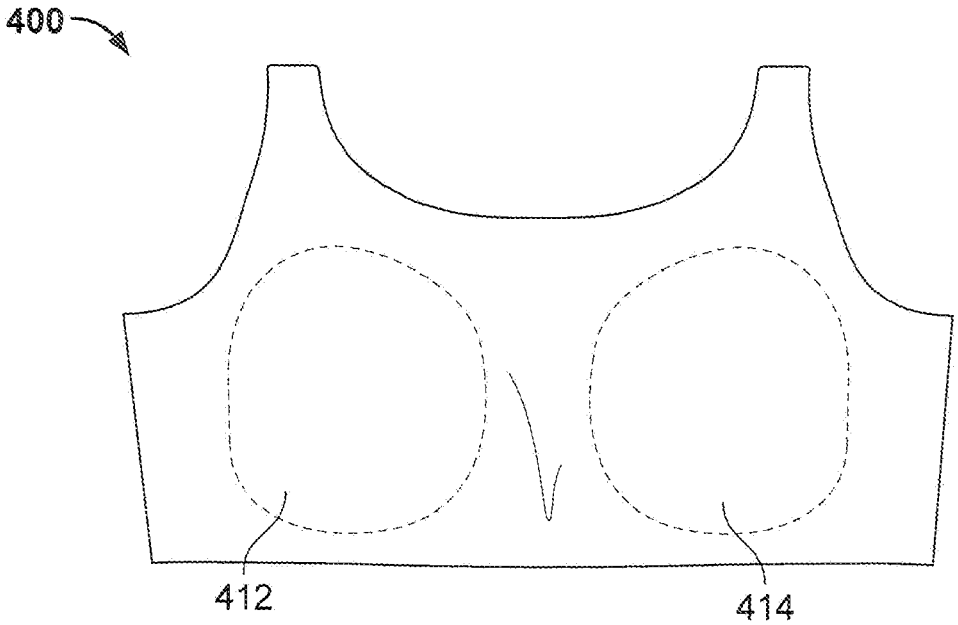
FIG. 4 illustrates an inner layer of a bra, according to an embodiment.

An inner layer 400 is illustrated in FIG. 4. The inner layer 400 includes molded bra cups 412 and 414. The bra cups 412, 414 may be molded to give the bra 100 a desired bra cup shape to support and adequately cover the breasts of a wearer of the bra 100. According to an embodiment, stitching may be added around the circumference of the molded bra cups 412, 414 to provide support and compression to the breasts. The stitching may be, for example, a zigzag stitching pattern, The inner layer 400 may be a warp knitted fabric. Moreover, the fabric may be a four-way stretch fabric, capable of stretching horizontally and vertically. According to another embodiment, the fabric may be a two-way stretch fabric, capable of stretching horizontally. The fabric of the inner layer 400, according to an embodiment, can be a wicking fabric or material, able to draw away moisture from skin to the next layers. As such, the fabric can be breathable. According to an embodiment, the fabric of the inner layer 400 can be 89% nylon and 11% spandex (e.g., LYCRA, ELASPAN, CREORA, ROICA, DORLASTAN, LINEL, ESPA), although other proportions of nylon and spandex, as well as other materials, may be used. The incorporation of spandex can provide support and compression, which can be enhanced with the stitching around the bra cups 412, 414. The fabric of the inner layer 400 may range from 150 to 340 GSM (grams per square meter). For example, according to an embodiment, the fabric of the inner layer may be 240 GSM.

Figure 5:
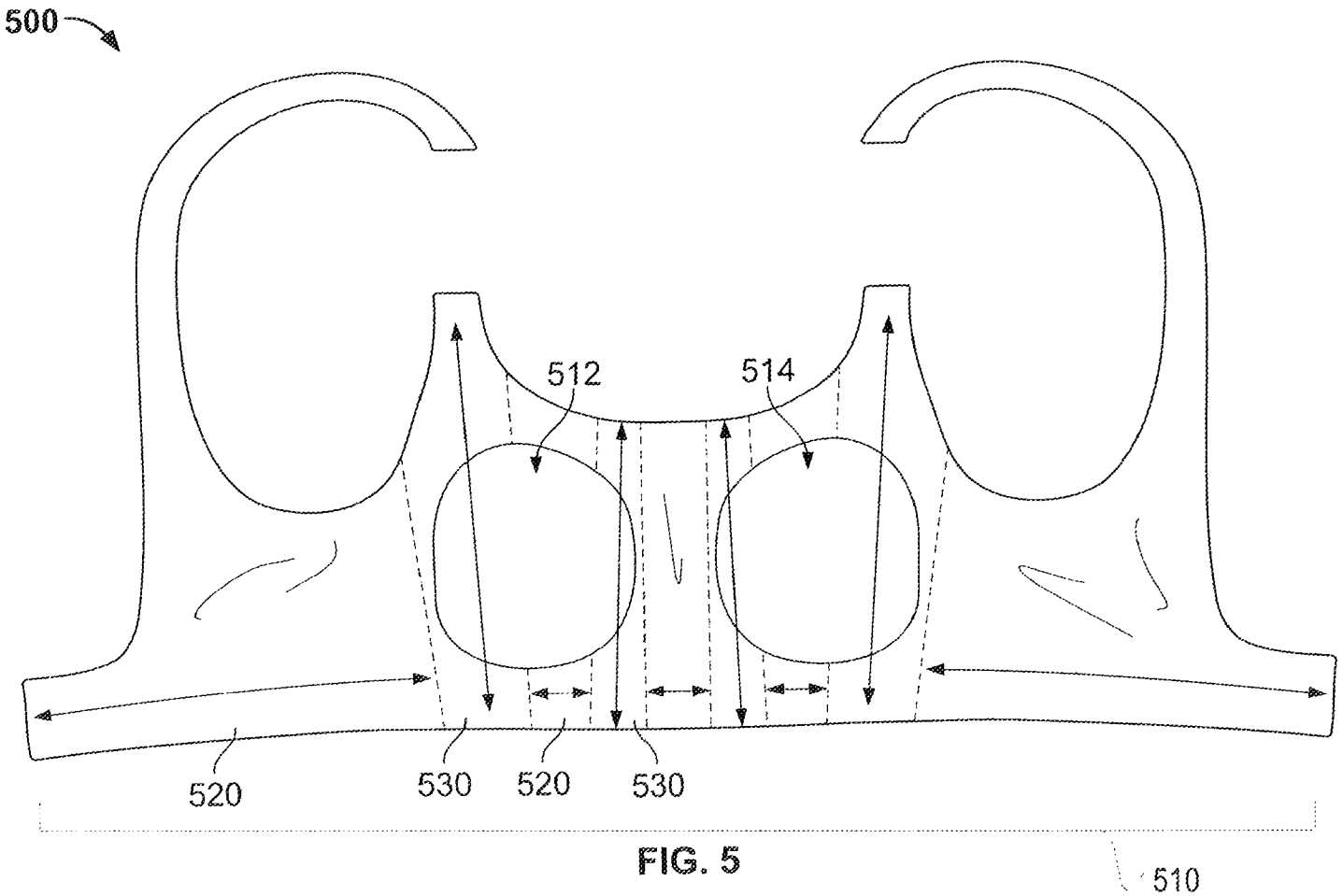
FIG. 5 illustrates an inner frame layer of a bra, according to an embodiment

FIG. 5 illustrates an inner frame layer 500, according to one embodiment. The inner frame layer 500 can include at least one panel 510 that can be primarily stretchable in a first direction, which according to an embodiment may be a horizontal direction.

According to an embodiment, the panel 510 may include a plurality of panels including alternating primary panels 520 and secondary panels 530. The primary panels 520 can be primarily stretchable in a first direction, which according to an embodiment may be a horizontal direction, while the secondary panels 530 can be primarily stretchable in a second direction, which according to an embodiment may be a vertical direction. The use of "horizontal" and "vertical" describes the direction of the panels 520, 530 when the bra 100 is held upright in a position in which the bra 100 is placed on a wearer. The second direction may be perpendicular to the first direction. According to another embodiment, the panels 520, 530 may be oriented at slight angles to the horizontal and vertical lines. Moreover, according to another embodiment, the direction of the orientation of the panels 520, 530 may be angles other than 90° with respect to one another. In some embodiments, the panels 520, 530 may also be oriented in any direction and at any angle with respect to each other. In addition, the panels can also be included in other layers (e.g., 400, 600, 700). In this way, layering different fabrics (e.g., using gluing, laminating, welding, or stitching, or any combination thereof) in different directions can allow pressure points to be generated around the breast, adding support and reducing breast movement (e.g., when walking, when moving, when exercising).

Figure 6:
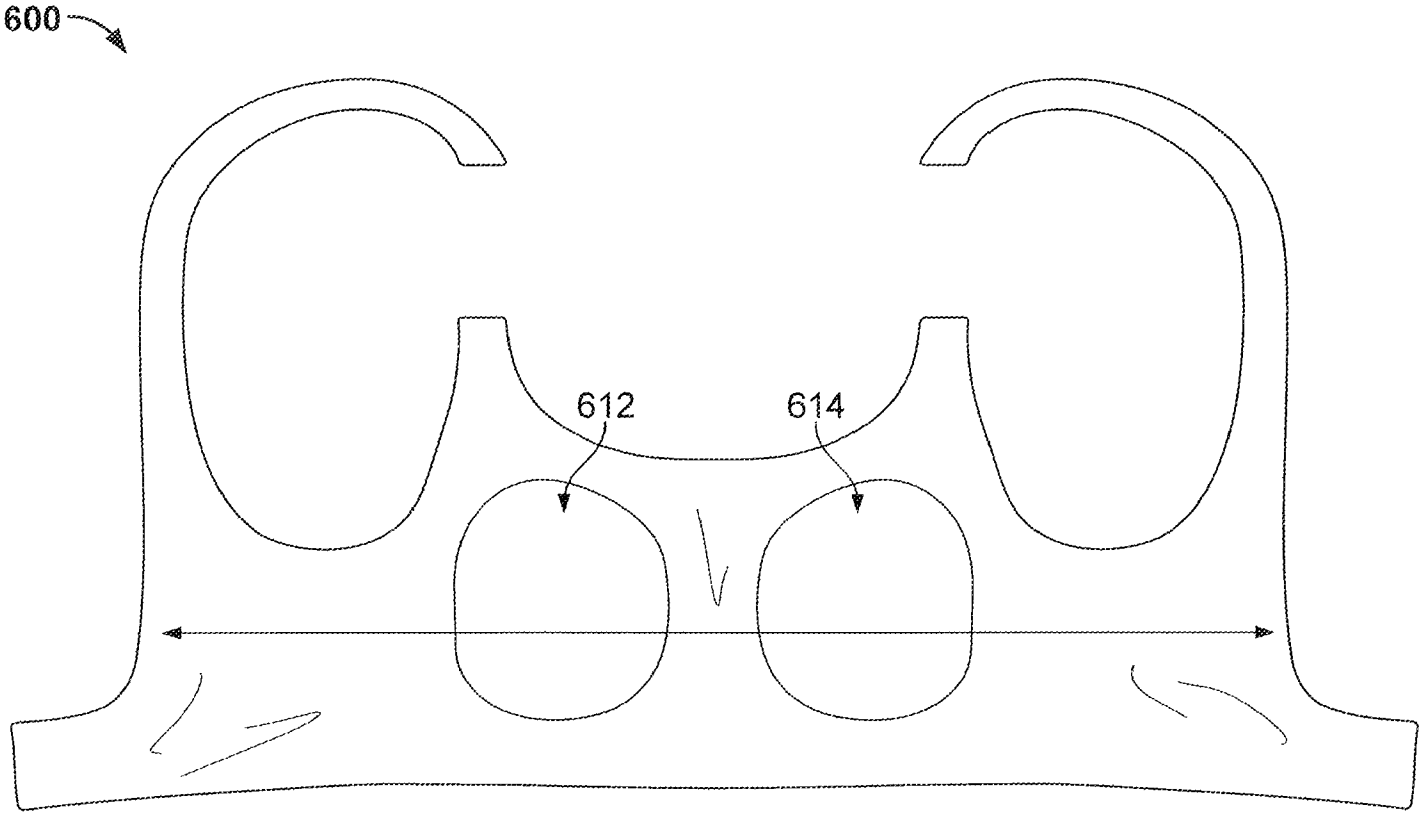
FIG. 6 illustrates an outer frame layer of a bra, according to an embodiment

FIG. 6 illustrates an outer frame layer 600, according to one embodiment. The outer frame layer 600 can be primarily stretchable in the first direction, for example, the horizontal direction as defined above. However, the outer frame layer 600 can be stretchable in any direction.

The inner frame layer 500 and the outer frame layer 600 can form a frame layer that encapsulates the breasts and provide support to the base of the breasts. The frame layer can be connected to the side portions 120, 122 (e.g., using gluing, laminating, welding, or stitching, or any combination thereof.) The side portions 120, 122 can provide circular pressure around the body to allow the frame layer to be held in place. Both the inner frame layer 500 and the outer frame layer 600 can have cutout sections, 512, 514 and 612, 614, respectively. The cut-out sections 512, 514 and 612, 614 can correspond in size to the bra cups 412, 414, providing for the bra cups 412, 414 formed in the inner layer 400 to extend through the frame layer. According to an embodiment, stitching can be added around the cut-out sections 512, 514 and 612, 614 to provide support to the breasts. The stitching may be, for example, a zigzag stitching pattern. The secondary panels 530 of the inner frame layer 500, according to an embodiment, may be vertical panels oriented in the portion near and surrounding the bra cups 412, 414, that serve to limit the stretch of the frame layer in the horizontal direction.

The inner frame layer 500 and the outer frame layer 600 may be a wicking fabric or material, able to draw away moisture to the next layer. As described above, the fabric of the frame layer (i.e., the inner frame layer 500 and the outer frame layer 600) may be a two-way stretch fabric, capable of stretching in a horizontal or vertical direction. The fabric of the inner and outer frame layers 500, 600 may be a warp knitted fabric. According to an embodiment, the fabric of the inner frame layer 500 and the outer frame layer 600 can be 87% nylon and 13% spandex, although other proportions of nylon and spandex, as well as other fabrics or materials, may be used. The fabric of the frame layer may range from 200 to 320 GSM. For example, the fabric of the frame layer, according to an embodiment, can be 245 GSM. According to an additional embodiment, the inner frame layer 500 and the outer frame layer 600 may be fabrics with a different GSM.

A chest band, such as the chest band 140 described above with reference to FIG. 1, may be part of the bra 100. According to an embodiment, the chest band, made of the same material as the frame layers 500, 600, can be attached to or extend from a bottom portion of one or both of the frame layers 500, 600. The chest band may include elastic material. The chest band may be attached to the frame layers 500, 600 by a variety of methods, such as gluing using hot melt or similar adhesives. The chestband elastic may be sewed by using zig zag sewing to the outer layer of fabric 600 and then glued to the outer frame fabric 500 by using either Bemis 3918 high recovery Thermoplastic Polyurethane (TPU) Elastomer tape, hot melt, or a similar adhesive, or any combination thereof.

Additionally, shoulder straps, such as the shoulder straps 130, 132 described above with respect to FIG. 1, may be an extension of the frame layers 500, 600. Thus, the shoulder straps 130, 132 may include two layers of two-way stretch, warp knitted wicking fabric of a composition of 87% nylon and 13% spandex, for example. The shoulder straps 130, 132 may be or may not be of the same material or composition as the frame layers 500, 600. The shoulder straps may be a fabric with a weight range of 200 to 320 GSM. The material of the shoulder straps 130, 132 can provide support to the breasts by reducing bounce due to the limited amount of stretch inherent in the material.

Figure 7:
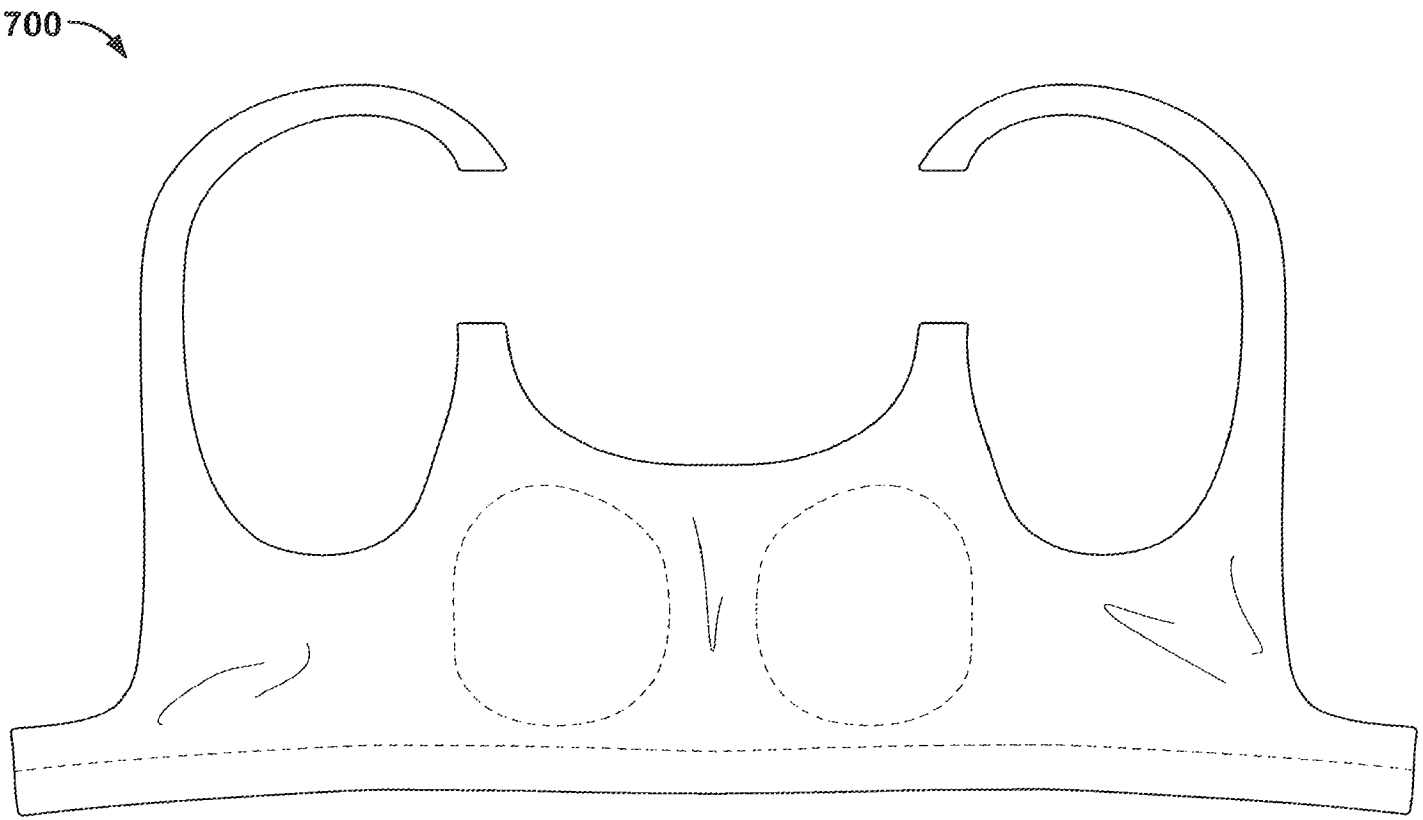
FIG. 7 illustrates an outer layer of a bra, according to an embodiment

FIG. 7 illustrates an outer layer 700, according to one embodiment. The outer layer 700 can be molded to conform to a size of the bra cups 412, 414. Thus, the outer layer 700 can seamlessly cover the bra cups 412, 414 that extend from the inner layer 400 through the cut-out sections 512, 514 and 612, 614 of the frame layers 500 and 600.

The outer layer 700 may be a weft knitted fabric. Moreover, the fabric may be a four-way stretch fabric, capable of stretching horizontally and vertically. The fabric of the outer layer 700, according to an embodiment, can be a wicking fabric or material, able to draw away moisture from the inner layers and spread out the moisture for quick drying. According to an embodiment, the fabric of the outer layer 700 may be of a range of 23% to 30% spandex and 70 to 77% nylon, such as 77% nylon and 23% spandex, although other proportions of nylon and spandex, as well as other materials, may be used. For example, the relatively high spandex content of 23% to 30% can provide compression to the outer layer 700. The fabric of the outer layer 700 may be of a range from 220 to 340 GSM, such as, for example, 240 GSM.

The outer layer 700, in addition to covering the bra cups 412, 414, may also cover shoulder straps, such as the shoulder straps 130, 132 described above with respect to FIG. 1, The outer layer 700 can also cover the area around the fastening mechanism 150. For example, the outer layer 700 can be provided with laser cut holes from which the hooks and eyes protrude. Thus, the outer layer 700 can serve to provide a clean seamless look, as well as a soft feel, to the bra 100.

According to an embodiment, the outer layer 700 can be bonded to the frame layer by, for example, a hot melt process which allows for moisture and air movement between the layers. The outer frame layer 600 and the inner frame layer 500 can be secured together by, for example, being glued together by, a hot melt process allowing for moisture and air movement between the frame layers 500 and 600. The plurality of panels in the inner frame layer 500 (the alternating primary panels 520 and secondary panels 530) can be, according to an embodiment, connected to one another by ultrasonic welding. The inner layer 400 may be stitched to the frame layer using an overlook marrow stitch, for example. The connection of the various layers and the panels are not limited to these techniques, and other known connection techniques may be employed to connect the layers and the panels.

Figure 8A:
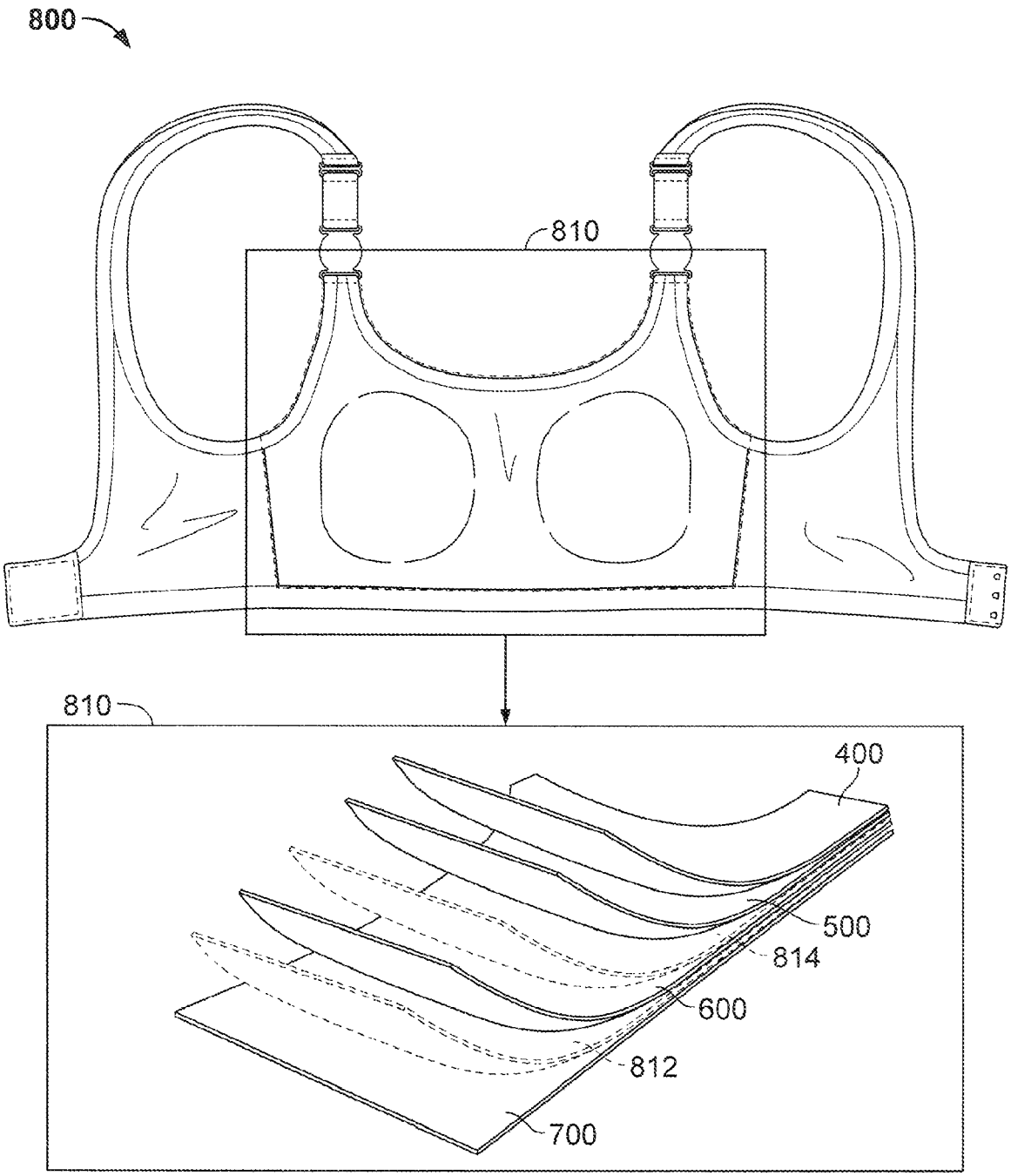
FIGS. 8*a* and 8*b* illustrate a front portion and a side portion, respectively, of a bra assembly, according to an embodiment.
Figure 8B:
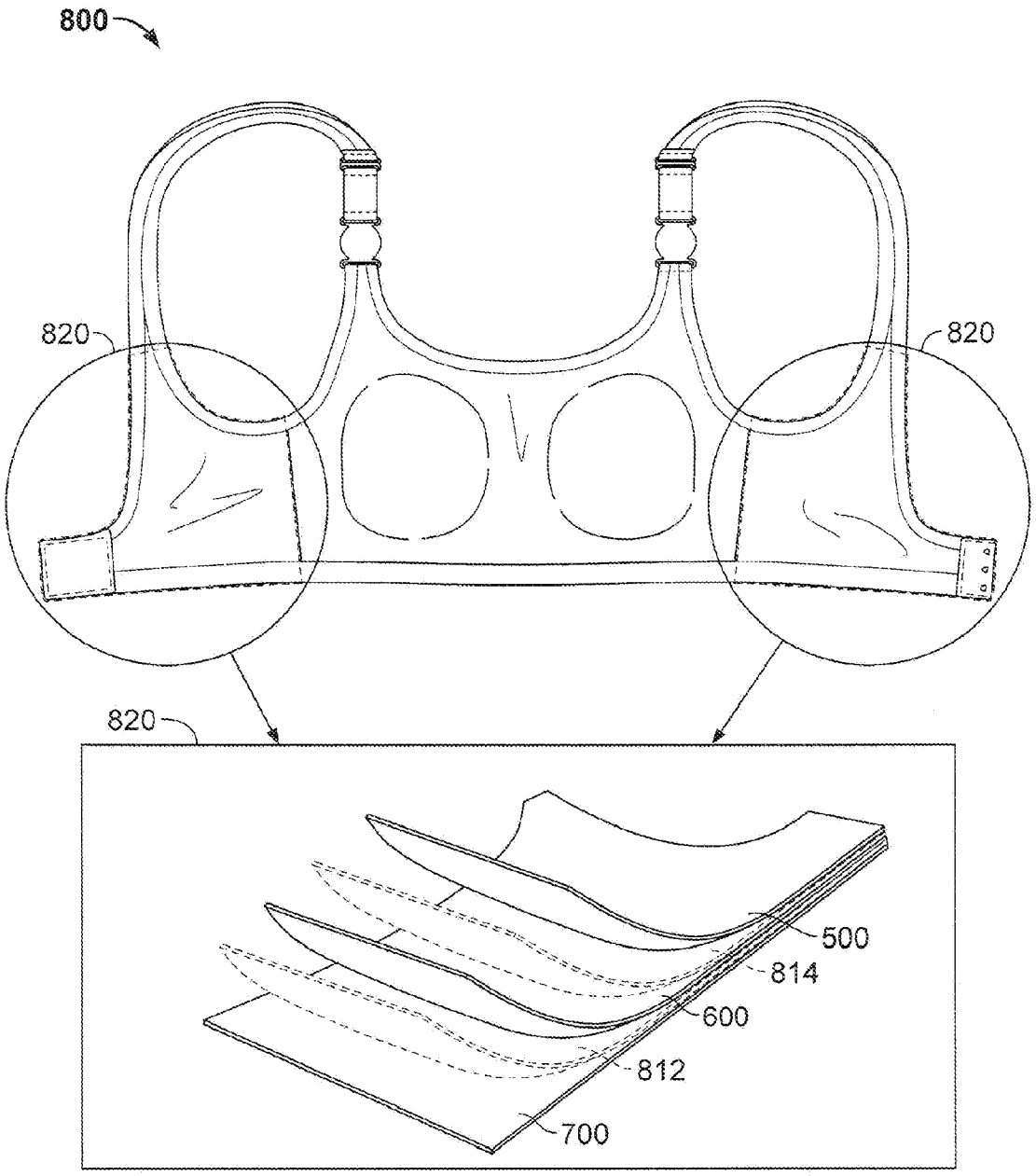

FIGS. 8*a* and 8*h* illustrate a bra assembly 800 including the layers 400, 500, 600, and 700 described above according to one embodiment. (Note that FIG. 8*a* illustrates the front view of the inner side of the bra.) The bra assembly 800 may include a front assembly 810 for the front portion 110 of the bra 100, as well as a side assembly 820 for the side portions 120, 122 of the bra 100.

According to an embodiment, one or more layers 400, 500, 600, and 700 included in the front portion 110 and the side portions 120, 122 may be one continuous piece of material. As such, layers of the front assembly 810 and the side assembly 820 may be continuous layers.

As shown in FIG. 8*a*, the front assembly 810 for the front portion 110 can include the outer layer 700, the outer frame layer 600, the inner frame layer 500, and the inner layer 400. Also included in the front assembly 810 can be attachment layers 812 and 814 for respectively connecting the outer layer 700 and the outer frame layer 600, and the outer frame layer 600 and the inner frame layer 500.

The side assembly 820 for the side portions 120, 122 can include the outer layer 700 and the frame layer made up of the outer frame layer 600 and the inner frame layer 500. Also included in the side assembly 820 can be attachment layers 812 and 814.

Figure 9:
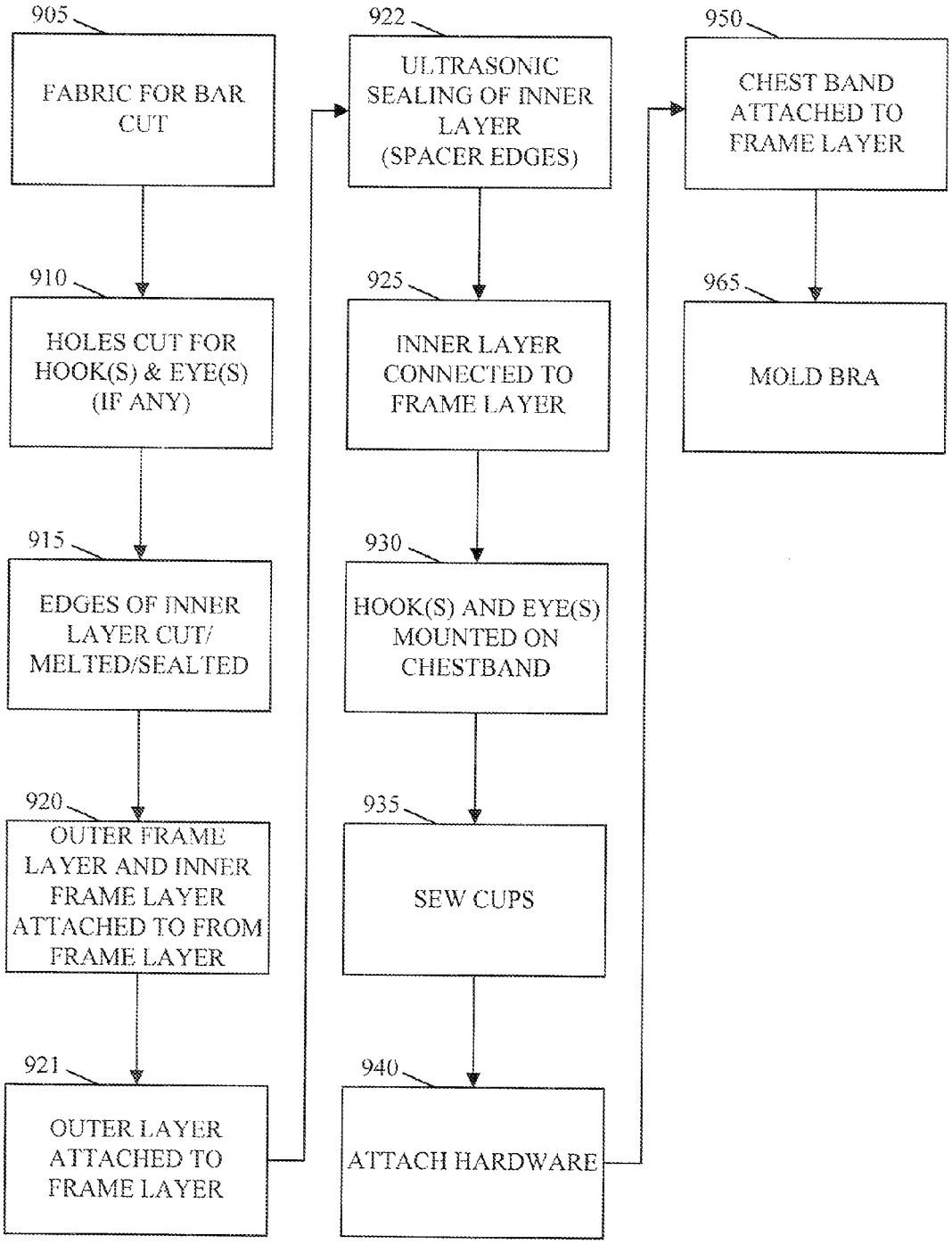
FIG. 9 illustrates a method of manufacturing bra 100, according to an embodiment.

FIG. 9 illustrates a process for manufacturing bra 100, according to one embodiment. Those of ordinary skill in the art will see that multiple other embodiments are also possible. In 905, some or all of the material for the various layers and elements of the bra 100 (e.g., outer frame layer 600, inner frame layer 500, inner layer 400, chest band 140) may be cut (e.g., according to size), using, for example, a straight knife, a band knife, an electric cutter, laser, etc. In 910, holes can be cut (e.g., for the hook(s) and eye(s) or other bra connecting items or materials) on the fabric for the outer frame layer 600, using, for example, a laser. In 915, the edges of the inner layer 400 (e.g., made of nylon spacer fabric) can be cut and/or melted and/or sealed (e.g., using an ultrasonic welding machine). (Note that in one embodiment, the nylon spacer fabric may have wire throughout the nylon spacer fabric that needs to be melted and/or sealed so that is doesn't poke or hurt anyone.) In 920, the outer frame layer 600 and the inner frame layer 500 can be attached, along with any other layers, to form a frame layer (e.g., by gluing, laminating, welding, or stitching, or any combination thereof). (Note that, in some embodiments, an attachment layer 814 (e.g., a sticky material or a material that is used to connect other materials) can be used to attach the inner frame layer 500 to the outer frame layer 600.) In 921, the outer layer 700 can be attached to the frame layer (e.g., by gluing, laminating, welding, or stitching, or any combination thereof). (Note that, in some embodiments, an attachment layer 812 (e.g., a sticky material or a material that is used to connect other materials) can be used to attach the outer layer 700 to the frame layer.) The above process can be utilized for the front assembly 810 and the side assembly 820. In 922, ultrasonic sealing of the inner layer 400 (spacer) edges may be done. For the front assembly, in addition, in 925, the inner layer 400 can be attached to the frame layer (e.g., using a stitch froman overlock serger). In 930, the hook(s) and eye(s) (or other bra connecting items or material) can be mounted on the ends of the chest band 140. In 935, sewing (e.g., zig zag) can be done around the cups 412, 414 of bra 100. In 940, hardware (e.g., 160, 161, 162, 163) or another item of another material can be attached to the bra straps so that the bra straps are adjustable. This can be done by running the ends of the bra straps and the ends of the tops of the front assembly that meet the bar straps through the hardware, and sewing the ends to the bra straps or the tops, as appropriate. In 950, the chest band 140 (e.g., made of a power luxtreme fabric) can be attached (e.g., by gluing, laminating, welding, or stitching, or any combination thereof) to the frame layer and the inner layer 400. For example, high recovery glue may be applied, in, for example, a dot form, to the chest band 140 and the frame layer and inner layer 400, and the frame layer and inner layer 400 can then be turned over and attached to the chest band 140. (Note that, in some embodiments, any substance may be applied in a dot form to connect one part of the bra to another.) In 965, the bra 100 can be put in a mold frame at a high temperature (e.g., 160-200 degrees centigrade) for 30-60 seconds to allow the bra cups to be molded and/or to allow any laminate or attachment material or item (e.g., hot melt film, high recovery glue) to melt and/or form a bond. Those of ordinary skill in the art will see that the above process is merely an example, and that many other processes could be utilized to manufacture the bra, including adding or taking away steps, or putting the steps in different order.

It should be noted, that, in the embodiment of the bra 900 shown in FIG. 10, the shoulder straps are adjusted in a manner different from the shoulder straps in the bra 100 of FIG. 1. In bra 900, a material (e.g., a power luxtreme fabric) can be used to form the shoulder loop shapes, which can be formed using a template while applying a high temperature weld.

The foregoing examples are provided merely for the purpose of explanation and are in no way to be construed as limiting. While reference to various embodiments are shown, the words used herein are words of description and illustration, rather than words of limitation. Further, although reference to particular means, materials, and embodiments are shown, there is no limitation to the particulars disclosed herein. Rather, the embodiments extend to all functionally equivalent structures and uses, such as are within the scope of the appended claims.

In addition, it should be understood that any figures which highlight the functionality and advantages, are presented for example purposes only. The disclosed methodology and system are each sufficiently flexible and configurable, such that it may be utilized in ways other than that shown.

Further, the purpose of the Abstract of the Disclosure is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract of the Disclosure is not intended to be limiting as to the scope of the present invention in any way.

It should also be noted that when the term "a", "an", etc. is used, it is to be interpreted as "at least one" throughout the application, drawings, and claims.

Finally, it is the applicant's intent that only claims that include the express language "means for" or "step for" be interpreted under 35 U.S.C. 112, paragraph 6. Claims that do not expressly include the phrase "means for" or "step for" are not to be interpreted under 35 U.S.C. 112, paragraph 6.

The invention claimed is:

1. A bra comprising:

a front portion, the front portion comprising bra cups;

two side portions, each side portion extending from a respective side of the front portion, wherein the side portions are adapted to encircle a torso of a wearer of the bra;

wherein the front portion and the side portions are comprised of an outer layer and a frame layer beneath the outer layer, the outer layer being on a first plane, and the frame layer being on a second plane under the first plane;

wherein the front portion is further comprised of an inner layer beneath the frame layer, wherein an innermost layer and an outermost layer of the bra cups are molded in the inner layer of the front portion, the inner frame layer being on a third plane under the second plane;

wherein the frame layer comprises:

an outer frame layer primarily stretchable in a first direction; and an inner frame layer comprising at least one panel primarily stretchable in a same direction as the first direction.

2. The bra of claim 1, wherein the frame layer comprises cut-out sections that correspond in size to the bra cups, providing encapsulation and separation of breasts, and providing for the bra cups formed in the inner layer of the front portion to extend through the frame layer.

3. The bra of claim 2, further comprising stitching around the cut-out sections in the frame layer.

4. The bra of claim 1, wherein the inner frame layer comprises a plurality of panels, wherein the panels alternate between primary panels primarily stretchable in the first direction and secondary panels primarily stretchable in a second direction.

5. The bra of claim 4, wherein the secondary panels comprise vertical panels situated in the front portion.

6. The bra of claim 4, wherein the plurality of panels are connected to one another by ultrasonic welding.

7. The bra of claim 1, wherein the outer frame layer and the inner frame layer are joined together by a hot melt process.

8. The bra of claim 1, wherein the outer layer is molded to conform to a size of the bra cups.

9. The bra of claim 1, wherein the outer layer is joined to the frame layer by a hot melt process.

10. The bra of claim 1, wherein the inner layer is joined to the frame layer by stitching.

11. The bra of claim 1, further comprising stitching around the circumference of the bra cups molded in the inner layer.

12. The bra of claim 1, further comprising:

shoulder straps that extend from a top portion of the front portion to respective top portions of the two side portions, wherein the shoulder straps are adapted to encircle shoulders of the wearer of the bra and comprise loops to provide a customized fit.

13. The bra of claim 12, wherein the shoulder straps and/or loops comprise the same material as the material that comprises the frame layer and the outer layer.

14. The bra of claim 1, further comprising:

a chest band extending from a bottom portion of the front portion.

15. The bra of claim 1, further comprising:

a fastening mechanism comprised of a set of hooks and a corresponding set of eyes, the set of hooks attached to an end portion of one of the two side portions, and the set of eyes attached to an end portion of the other of the two side portions, wherein the fastening mechanism is adapted to secure the bra to the wearer.

16. The bra of claim 1, wherein the outer layer and the frame layer of both the front portion and the side portions are continuous pieces of material.

17. A bra assembly comprising:

a frame layer comprising:

an outer frame layer primarily stretchable in a first direction; and an inner frame layer comprising at least one panel primarily stretchable in the first direction; and an inner layer comprising molded bra cups; and an outer layer molded to conform to a size of the bra cups;

wherein the outer layer is bonded to the frame layer, the outer frame layer and the inner frame layer are glued together, and the inner layer is stitched to the frame layer; and wherein the frame layer comprises cut-out sections that correspond in size to the bra cups, providing for the bra cups formed in the inner layer to extend through the frame layer;

wherein the outer layer comprises a perimeter edge that corresponds to a perimeter edge of the bra cups.

18. The bra of claim 17, wherein the inner frame layer comprises a plurality of panels, wherein the panels alternate between primary panels primarily stretchable in the first direction and secondary panels primarily stretchable in a second direction.

19. The bra assembly of claim 18, wherein the second direction is perpendicular to the first direction.

20. The bra assembly of claim 17, wherein the frame layer is comprised of a two-way stretch wicking fabric.

21. The bra assembly of claim 20, wherein the frame layer is a fabric comprised of between 80% to 95% nylon and 20% to 5% spandex, and the unit weight ranges from 200 to 320 GSM (grams per square meter).

22. The bra assembly of claim 17, wherein the outer layer is comprised of a four-way or a two-way stretch fabric comprising at least one of: warp knitted fabric, wicking fabric, breathable fabric, or any combination thereof.

23. The bra assembly of claim 22, wherein the outer layer is a fabric comprised of between 70% to 77% nylon and between 30% to 23% spandex, and the unit weight ranges from 220 to 340 GSM (grams per square meter).

24. The bra assembly of claim 17, wherein the inner layer is comprised of a four-way or a two-way stretch fabric comprising at least one of: warp knitted fabric, wicking fabric, or breathable fabric, or any combination thereof.

25. The bra assembly of claim 24, wherein the inner layer is a fabric comprised of 80% to 95% nylon and 20% to 5% spandex, and the unit weight ranges from 200 to 340 GSM (grams per square meter).

26. The bra assembly of claim 17, wherein the outer frame layer and the inner frame layer are joined together by a hot melt process.

27. The bra assembly of claim 17, wherein the plurality of panels are connected to one another by laser welding.

28. The bra assembly of claim 17, wherein the outer layer is joined to the frame layer by a hot melt process.

29. The bra assembly of claim 17, wherein the inner layer is joined to the frame layer by stitching.

30. The bra of claim 1, wherein all the edges of the innermost layer of the bra cups are cut and sealed by ultrasonic welding.

31. The bra of claim 1, further comprising:

a chest band at a bottom portion of the bra, the chest band comprising:

elastic that is 25 mm wide woven elastic;

50% to 85% nylon;

50% to 15% spandex;

a brushed surface; or a modulus of 1.25 lbf at 20% extension;

or any combination thereof.

32. The bra of claim 1, further comprising shoulder straps and adjustable shoulder loops such that the loops allow for shoulder strap adjustment.

* * * * *